US008366566B1

(12) United States Patent
Rollinson

(10) Patent No.: US 8,366,566 B1
(45) Date of Patent: Feb. 5, 2013

(54) IRON-TYPE GOLF CLUB WITH VIBRATION DAMPING

(75) Inventor: Augustin W. Rollinson, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 570 days.

(21) Appl. No.: 12/632,675

(22) Filed: Dec. 7, 2009

(51) Int. Cl.
*A63B 53/04* (2006.01)

(52) U.S. Cl. ..... 473/332; 473/342; 473/350

(58) Field of Classification Search ..... 473/324–350
See application file for complete search history.

(56) References Cited

U.S. PATENT DOCUMENTS 1,607,284 A * 11/1926 Kraeuter ..... 473/332
3,084,940 A * 4/1963 Cissel ..... 473/332
4,545,580 A * 10/1985 Tomita et al. ..... 473/332
4,824,110 A * 4/1989 Kobayashi ..... 473/332
4,928,972 A * 5/1990 Nakanishi et al. ..... 473/332
5,064,197 A * 11/1991 Eddy ..... 473/326
5,288,070 A * 2/1994 Chen ..... 473/331
5,290,036 A * 3/1994 Fenton et al. ..... 473/332
5,316,298 A * 5/1994 Hutin et al. ..... 473/332
5,316,305 A * 5/1994 McCabe ..... 473/332
5,409,229 A * 4/1995 Schmidt et al. ..... 473/332
5,411,255 A * 5/1995 Kurashima et al. ..... 473/332
5,529,543 A * 6/1996 Beaumont, Sr. ..... 473/290
5,586,947 A * 12/1996 Hutin ..... 473/324
5,586,948 A * 12/1996 Mick ..... 473/332
5,588,923 A * 12/1996 Schmidt et al. ..... 473/340
5,658,208 A * 8/1997 Shimasaki ..... 473/349
5,692,972 A * 12/1997 Langslet ..... 473/332
5,697,855 A * 12/1997 Aizawa ..... 473/350
5,766,092 A * 6/1998 Mimeur et al. ..... 473/329
5,899,821 A * 5/1999 Hsu et al. ..... 473/332
6,042,486 A * 3/2000 Gallagher ..... 473/329
6,045,456 A * 4/2000 Best et al. ..... 473/291
6,086,485 A * 7/2000 Hamada et al. ..... 473/329
6,159,109 A * 12/2000 Langslet ..... 473/332
6,443,857 B1 * 9/2002 Chuang ..... 473/332
6,743,114 B2 * 6/2004 Best ..... 473/291
6,743,117 B2 * 6/2004 Gilbert ..... 473/332
6,835,144 B2 * 12/2004 Best ..... 473/332
6,855,066 B2 * 2/2005 Best ..... 473/291
6,991,560 B2 * 1/2006 Tseng ..... 473/332
7,083,525 B2 * 8/2006 Pond et al. ..... 473/251
7,186,188 B2 * 3/2007 Gilbert et al. ..... 473/290
7,238,119 B2 * 7/2007 Roach et al. ..... 473/350
7,244,188 B2 * 7/2007 Best ..... 473/291
7,273,423 B2 * 9/2007 Imamoto ..... 473/332
7,281,988 B2 * 10/2007 Hou ..... 473/326
7,303,485 B2 * 12/2007 Tseng ..... 473/332
7,303,486 B2 * 12/2007 Imamoto ..... 473/332
7,390,270 B2 * 6/2008 Roberts et al. ..... 473/332
7,476,162 B2 1/2009 Stites et al.
7,491,136 B2 * 2/2009 Deng et al. ..... 473/349
7,559,850 B2 * 7/2009 Gilbert et al. ..... 473/290
7,575,523 B2 * 8/2009 Yokota ..... 473/332

(Continued)

*Primary Examiner* — Alvin Hunter
(74) *Attorney, Agent, or Firm* — Michael A. Catania; Rebecca Hanovice; Sonia Lari

(57) ABSTRACT

The present invention relates to an iron-type golf club head which comprises a body member with a central cavity therein, a damping member and a face member disposed within the central cavity. Further, the rear surface of the body member includes an opening, preferably circular in shape. The body member is composed of a first metal material and the face member is composed of a second metal material. The damping member is preferably composed of a EPDM material.

7 Claims, 3 Drawing Sheets

U.S. PATENT DOCUMENTS

| | | | | |
|---|---|---|---|---|
| 7,585,232 | B2 | 9/2009 | Krumme | |
| 7,588,502 | B2 * | 9/2009 | Nishino | 473/332 |
| 7,588,503 | B2 | 9/2009 | Roach et al. | |
| 7,597,633 | B2 | 10/2009 | Shimazaki et al. | |
| 7,621,822 | B2 | 11/2009 | Roach | |
| 7,654,914 | B2 * | 2/2010 | Roach et al. | 473/350 |
| 7,713,141 | B2 * | 5/2010 | Yamamoto | 473/332 |
| 7,749,101 | B2 * | 7/2010 | Imamoto et al. | 473/332 |
| 7,775,904 | B2 * | 8/2010 | Hirano | 473/332 |
| 7,833,110 | B2 * | 11/2010 | Nakamura | 473/332 |
| 7,922,604 | B2 * | 4/2011 | Roach et al. | 473/350 |
| 7,993,215 | B1 * | 8/2011 | Rentz | 473/334 |
| 8,083,610 | B2 * | 12/2011 | Roberts et al. | 473/329 |
| 2003/0027662 | A1 * | 2/2003 | Werner et al. | 473/346 |
| 2004/0171434 | A1 * | 9/2004 | Radcliffe et al. | 473/324 |
| 2007/0054752 | A1 * | 3/2007 | Lai | 473/340 |

* cited by examiner

1/3

IRON-TYPE GOLF CLUB WITH VIBRATION DAMPING

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to an iron-type golf club. More specifically, the present invention relates to an iron-type golf club with improved vibration damping.

2. Description of the Related Art

The prior art discloses various methods for vibration damping. One such example is U.S. Pat. No. 7,621,822 issued to Roach for Iron Golf Club with Improved Mass Properties and Vibration Damping. This patent discloses a golf club having a multiple material construction, wherein the center of gravity is located downward and rearward of the golf club head, while providing vibration damping.

Another example is U.S. Pat. No. 7,597,633 to Shimazaki, et al. for Golf Club Head, which discloses a golf club head with a spacer member formed of a viscoelastic body with vibration damping performance. Yet another example is U.S. Pat. No. 7,476,162 issued to Stites, et al. for Golf Club Head Having a Bridge Member and Damping Element. This patent discloses a golf club head comprising a damping element which reduces the vibration and sound of the golf club head upon impact with a golf ball.

Another example is U.S. Pat. No. 7,585,232 issued to Krumine for Golf Club Head, which discloses the use of a polyurethane elastomer to provide vibration damping. A further example of vibration damping is disclosed in U.S. Pat. No. 7,588,503 to Roach et al. for Multi-Piece Golf Club Head with Improved Inertia. This patent discloses the use of larger amount of viscoelastic material to achieve a greater variety of club head characteristics, including vibration damping.

BRIEF SUMMARY OF THE INVENTION

The present invention provides an iron-type golf club head which has a low center of gravity, a high moment of inertia, reduced vibrations, and a solid feel and appearance. The golf club head includes a plurality of members. A body member includes a rear surface, a sole surface, a crown surface, and a front surface. The front surface has a central cavity disposed within, and the rear surface has an opening.

A damping member is disposed within the cavity of the front surface. The damping member has a mass that ranges from 5 grams to 30 grams and is preferably composed of an EPDM material. A face member is mounted in the central cavity of the front surface and the face member is preferably composed of a titanium alloy.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
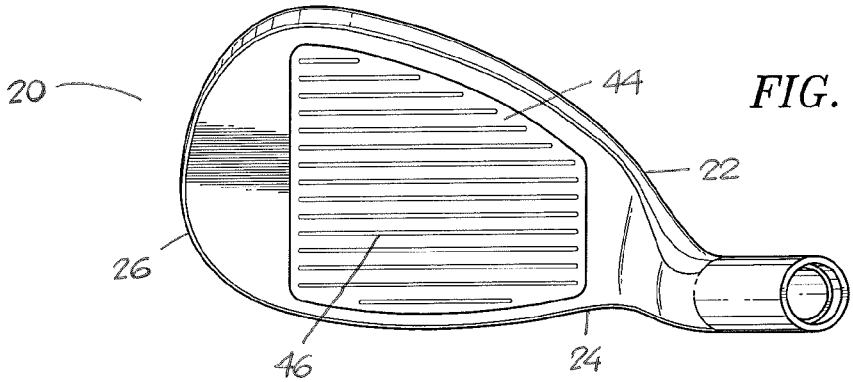
FIG. 1 is a perspective view of the invention.
Figure 2:
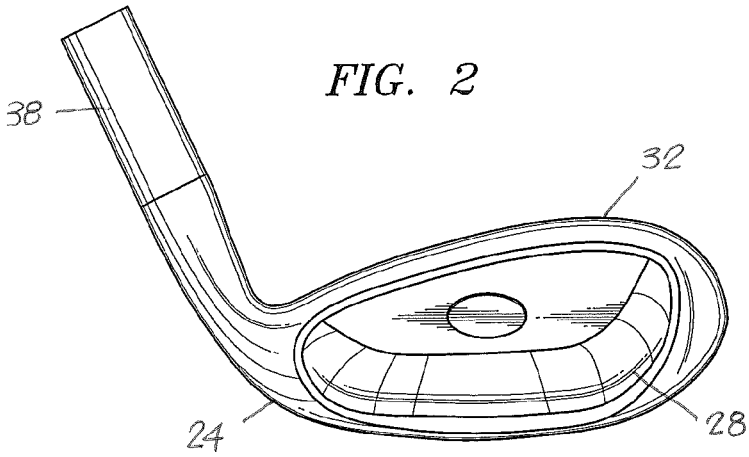
FIG. 2 is a rear plan view of the iron club head of FIG. 1.
Figure 3:
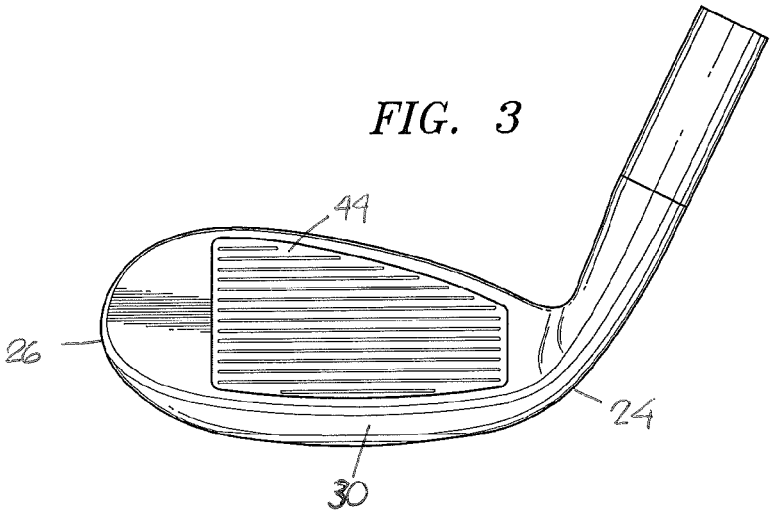
FIG. 3 is a front plan view of the iron club head of FIG. 1.
Figure 4:
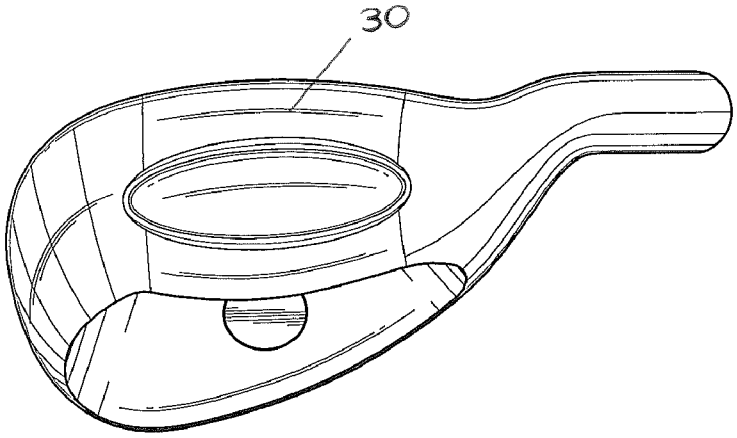
FIG. 4 is a bottom plan view of the iron club head of FIG. 1.
Figure 5:
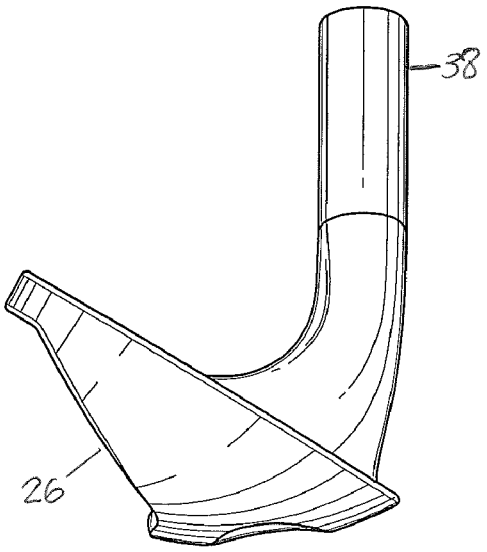
FIG. 5 is a toe side view of the iron club head of FIG. 1.
Figure 6:
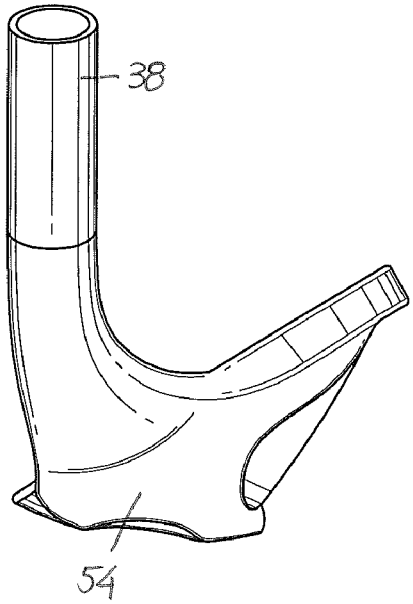
FIG. 6 is a heel side view of the iron club head of FIG. 1.

As shown in FIGS. 1-10, an iron-type golf club head in accordance with the present invention is generally designated 20. The club head 20 is an iron-type golf club head and includes a body 22 having a heel end 24 and a toe end 26. The body 22 has a rear surface 28, a sole surface 30 and crown surface 32. Further, the body has a front surface 34 wherein the front surface 34 has a central cavity therein 36. The body has a hosel 38 for receiving a shaft, not shown. In a preferred embodiment the body member 22 of the golf club head 20 is composed of an iron alloy, however, those of ordinary skill in the art will appreciate that the golf club head 20 may also be composed of other materials, such as carbon steel, titanium, titanium alloy, zirconium or zirconium alloy.

Disposed within the cavity 36 of the front surface 34 is a damping member 40. The damping member 40 is preferably composed of an EPDM material. Alternatively, the damping member 40 may be composed of a viscoelastic material. The damping member 40 is located directly behind the ball-striking surface 44, as well as around the perimeter of the face member 42, where significant vibration could occur. A face member 42 is mounted to the central cavity 36 of the front surface 34 and is disposed over the damping member 40. The face member 42 of the golf club head 20 is preferably composed of a titanium alloy. The ball-striking surface 44 of the face member 42 has a plurality of scorelines 46 formed therein. In a preferred embodiment the top of the hosel 30 is lower than the toe end 26 of the front wall 34, thereby lowering the center of gravity of the club head 20.

The golf club head 20 also has a crown surface 32, a sole surface 30, a heel wall 54, a toe wall 56 and a rear surface 28. The crown surface 32 extends rearward from the top end of the front wall 34, in a direction opposite the ball-striking surface 44, to the rear surface 28 of the body 22. The sole surface 30 extends rearward from the bottom end of the front wall 34 to the rear surface 28. The heel wall 54 extends rearward from the heel end 24 of the front wall 34 to the rear surface 28, and the toe wall 56 extends rearward from the toe end 26 of the front wall 34 to the rear surface 28. The rear surface 28, the crown surface 32, the sole surface 30, the heel wall 54 and the toe wall 56 define a central cavity 36 in the front surface 34 of the club head 20. The crown surface 32, the sole surface 30, the heel wall 54 and the toe wall 56 also provide the club head 20 with perimeter weighting to make the club head more forgiving and provide better performance for the typical golfer.

Figure 7:
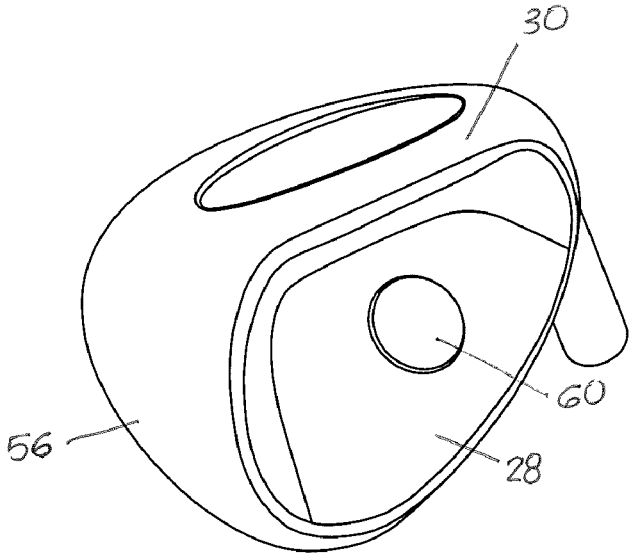
FIG. 7 is bottom plan view of the rear surface of the iron club head of FIG. 1.
Figure 8:
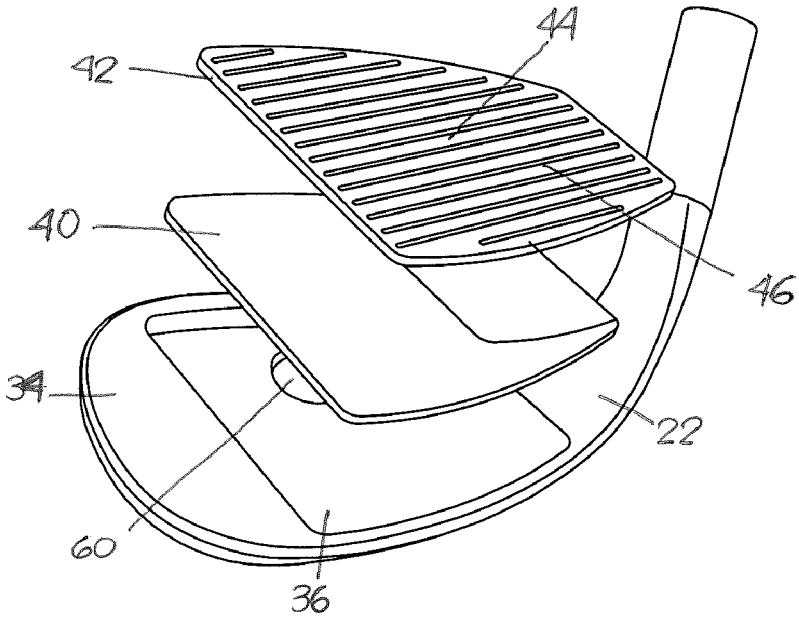
FIG. 8 is an exploded view of the body, damping, and face member of the present invention.

As best illustrated in FIG. 7, the rear surface 28 includes an opening 60, which is preferably circular in shape. A portion of the damping member 40 is exposed due to the opening 60 in the rear surface 28.

The axes of inertia are designated X, Y and Z. The X-axis extends from rear of the golf club head 20 through the center of gravity, CG, and to the front wall. The Y-axis extends from the heel end 24 of the golf club head 20 through the center of gravity, CG, and to the toe end 26 of the golf club head 20. The Z-axis extends from the bottom wall through the center of gravity, CG, and to the top wall.

As defined in *Golf Club Design, Fitting, Alteration & Repair,* $4^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moments of inertia of the golf club head 20 are preferably measured using a test frame ($X^T$, $Y^T$, $Z^T$), and then transformed to a head frame ($X^H$, $Y^H$, $Z^H$) The center of gravity of the golf club head 20 may be obtained using a center of gravity table having two weight scales thereon, as disclosed in U.S. Pat. No. 6,607,452, entitled High Moment Of Inertia Composite Golf Club, and hereby incorporated by reference in its entirety. If a shaft is present, the shaft is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

In general, the moment of inertia, Izz, about the Z-axis for the golf club head 20 preferably ranges from 2100 g-cm$^2$ to 2700 g-cm$^2$. The moment of inertia, Iyy, about the Y-axis for the golf club head 20 preferably ranges from 400 g-cm$^2$ to 800 g-cm$^2$. The moment of inertia, Ixx, about the X-axis for the golf club head 20 preferably ranges from 2200 g-cm$^2$ to 2800 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as our invention the following:

1. An iron-type golf club head comprising:

a body member composed of a first metal material having a density between 8 g/cm$^3$ and 12 g/cm$^3$, the body member having a rear surface, a sole surface, a crown surface, and a front surface, wherein the front surface has a central cavity therein and the rear surface has an opening therein;

a damping member disposed in the central cavity of the front surface, the damping member having a mass that ranges from 5 grams to 30 grams; and a face member mounted in the central cavity of the front surface and disposed over the damping member, the face member composed of a second metal material;

wherein the damping member is located directly behind the front surface of the face member and around a perimeter of the face member.

2. The iron-type golf club head according to claim 1 wherein the first metal material comprises an iron alloy.

3. The iron-type golf club head according to claim 1 wherein the damping member material comprises an EPDM material.

4. The iron-type golf club head according to claim 1 wherein the damping member material comprises a viscoelastic material.

5. The iron type golf club head according to claim 1 wherein the second metal material is a titanium alloy.

6. The iron-type golf club head according to claim 1 wherein the opening in the rear surface is circular shaped.

7. An iron-type golf club head, comprising:

a body member composed of a metal material having a density between 8 g/cm$^3$ and 12 g/cm$^3$, the body having a rear surface, a sole surface, a crown surface, and a front surface, wherein the front surface has a central cavity therein, the central cavity having a perimeter that generally parallels a perimeter of the body member, the body member having a mass that ranges from 100 grams to 240 grams;

a damping member composed of a viscoelastic material, the damping member disposed in the central cavity; and a face member composed of a titanium alloy material mounted in the central cavity of the body member and disposed over the damping member;

wherein the damping member is located directly behind the front surface of the face member and around a perimeter of the face member.

* * * * *